United States Patent [19]

Johnson

[11] 4,184,410

[45] Jan. 22, 1980

[54] LOW PRESSURE SIGNAL DRIVEN FLOW CONTROL SYSTEM

[75] Inventor: Howard L. Johnson, Joliet, Ill.

[73] Assignee: Caterpillar Tractor Co., Peoria, Ill.

[21] Appl. No.: 886,842

[22] Filed: Mar. 15, 1978

[51] Int. Cl.[2] ..... F15B 13/042

[52] U.S. Cl. ..... 91/421; 91/446; 137/596

[58] Field of Search ..... 91/421, 433, 446, 448, 91/451; 137/596, 596.13, 112; 60/459

[56] References Cited

U.S. PATENT DOCUMENTS

| | | | |
|---|---|---|---|
| 698,483 | 4/1902 | Faith et al. | 137/112 |
| 2,778,373 | 1/1957 | Jaquith | 137/112 |
| 3,008,481 | 11/1961 | Matheson | 137/112 |
| 3,455,210 | 7/1969 | Allen | 91/446 |
| 3,693,506 | 9/1972 | McMillen et al. | 91/433 X |
| 3,951,162 | 4/1976 | Wilke | 137/106 |
| 3,984,979 | 10/1976 | Budzich | 60/445 |
| 3,998,134 | 12/1976 | Budzich | 91/412 |

OTHER PUBLICATIONS

V400 Series Valves (Apparent Publication).

*Primary Examiner*—Irwin C. Cohen
*Attorney, Agent, or Firm*—Wegner, Stellman, McCord, Wiles & Wood

[57] ABSTRACT

A hydraulic system including a bidirectional hydraulic motor having first and second fluid ports, a pump, a control valve for selectively connecting the pump to (a) the first port and venting the second port and (b) the second port and venting the first port, a modulating valve interposed between the pump and the control valve for varying flow from the pump to the control valve, a pilot for the modulating valve, and a resolver for selecting the lowest pressure at the motor ports and for directing a fluid signal proportional thereto to the pilot to control the modulating valve.

3 Claims, 1 Drawing Figure

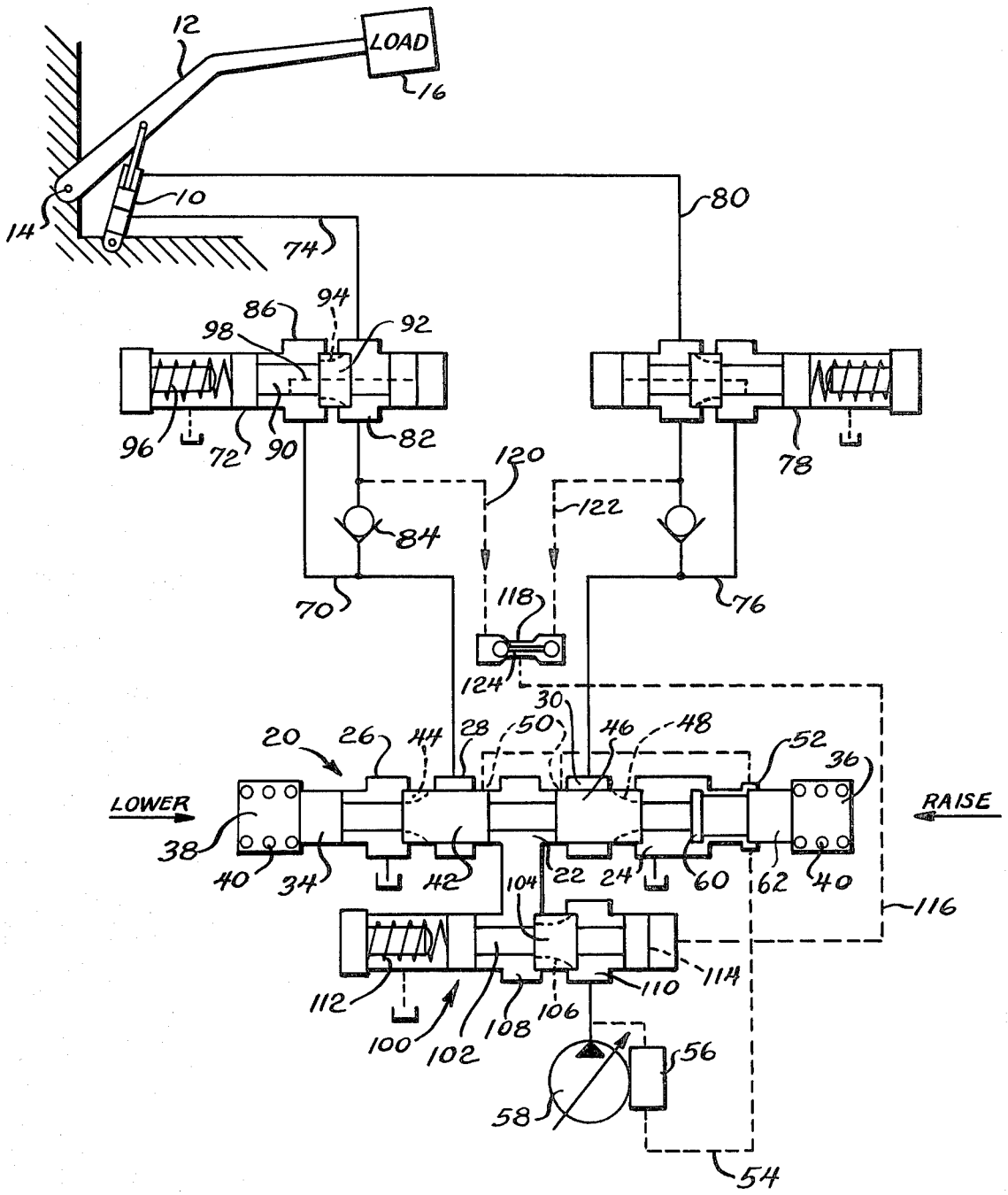
LOAD
LOWER
RAISE

LOW PRESSURE SIGNAL DRIVEN FLOW CONTROL SYSTEM

BACKGROUND OF THE INVENTION

This invention relates to hydraulic systems and, more specifically, to flow control in hydraulic systems.

Many hydraulic systems in use today utilize pumps that are pressure compensated and/or flow and pressure compensated. When the outputs of such pumps are directed to hydraulic motors such as double-acting hydraulic cylinders, some means must be provided to match the flow of fluid from the pump to the motor with the flow of fluid from the motor to the system reservoir. Such flow matching not only prevents cavitation in so-called negative load conditions, but also prevents the increasing of pump output pressure which would occur due to the operation of its pressure compensation circuit if the flows were not matched.

Flow matching, while attainable, is an expensive feature in a hydraulic system in that it requires the provision of controlled size orifices or matched springs in flow control valves when achieved according to many prior art teachings.

When achieved according to other prior art teachings, it has been accomplished solely by monitoring the exhaust flow from the hydraulic motor and, as a practical matter, this has resulted in rather unwieldy valve designs requiring many cores for the various passages and cross connections of certain of the cores. This, in turn, has required the use of bridging elements which may be subject to leakage, thereby decreasing system efficiency and/or the location of fluid ports in a large variety of planes within the valve body, all of which add considerable expense to the cost of the valve.

SUMMARY OF THE INVENTION

The present invention is directed to overcoming one or more of the above problems.

According to the present invention, there is provided a hydraulic system including a bidirectional hydraulic motor having first and second fluid ports. A pump is also included. A control valve is provided for selectively connecting the pump to the first port and venting the second port or for connecting the pump to the second port and venting the first port.

A modulating valve is interposed between the pump and the control valve for varying flow from the pump to the control valve and there is provided an actuator for the modulating valve. The system includes means for determining the relative pressures at the ports and for providing a control signal representative of the pressure having a pre-selected relation with respect to the other to the actuator for the modulating valve.

Other objects and advantages will become apparent from the following specification taken in connection with the accompanying drawings.

DESCRIPTION OF THE DRAWINGS

The FIGURE is a schematic of a hydraulic system embodying the invention.

DESCRIPTION OF THE PREFERRED EMBODIMENT

As seen in the FIGURE, a hydraulic motor 10 in the form of a double-acting hydraulic cylinder has its rod connected by a suitable pivot to an arm 12. One end of the arm 12 is pivoted at 14 while the other bears a load

16 to be lifted or lowered. It is to be specifically understood that while the circuit will be described in connection with a cylinder as the motor 10, the invention can be used with equal efficacy in hydraulic systems wherein the motor is of the type providing a rotary output.

The system includes a control valve, generally designated 20, of known construction. The same includes an inlet port and annulus 22, spaced exhaust ports and annuluses 24 and 26 which are connected to tank as schematically illustrated and intermediate annuluses 28 and 30 which are connected to the motor by means to be described. A shiftable spool 34 regulates fluid communication between the various ports in a conventional fashion. The spool 34 may be directly manually operated by a suitable lever (not shown) or, more preferably, be pilot operated by pilots 36 and 38. Typically, the spool 34 will be spring-centered as by springs 40 and, as seen in the FIGURE, the same is in its centered position.

The spool 34 includes a land 42 provided with metering slots 44 such that when the spool 34 is shifted to the right, as viewed in the FIGURE, fluid communication from the annulus 28 to the exhaust port 26 is established. When such movement occurs, a land 46 is shifted to the right to establish fluid communication between the inlet port 22 and the annulus 30. The land 46 also includes metering slots 48 which establish fluid communication between the annulus 30 and the exhaust port 24 when the spool is shifted to the left. When such leftward shifting occurs, fluid communication between the annulus 28 and the port 22 is established.

Adjacent the sides of the annulus of the inlet port 22 are load sensing ports 50. It will be appreciated that one or the other of the ports 50 will be unblocked whenever fluid communication from the inlet 22 to one of the annuluses 28 and 30 is established.

The load sensing ports 50 are connected to an annulus 52 which, in turn, is connected by a line 54 to the pressure compensating control, or flow and pressure compensating control 56 for a variable displacement pump 58. In this connection, the spool 34 carries a pair of spaced lands 60 and 62 which are configured such that the annulus 52 is in fluid communication with the exhaust port 24, and thus with the reservoir whenever the spool 34 is centered. Conversely, whenever the spool 34 is not centered, one or the other of the lands 60 and 62 will block the path from the annulus 52 to the annulus 24 so that a load signal is placed on the line 54 to control the pump 58.

The annulus 28 is connected via a line 70 to a spool valve 72 which, in turn, has an outlet connected via a line 74 to the head end of the cylinder 10. A similar line 76 connects the annulus 30 via a valve 78 and a line 80 to the rod end of the cylinder 10.

The valves 72 and 78 regulate exhaust flow from the corresponding end of the cylinder 10 in a generally conventional fashion and are identical. Hence, only the valve 72 will be described, and then only briefly. The line 74 is connected to a port 82 which is also connected via a check 84 to the line 70. Hence, when pressure in the line 70 is greater than the pressure in the line 74, fluid flow will pass through the check 84 from the line 70 directly to the line 74. Conversely, when the pressure in the line 74 is greater than that in the line 70, the check 84 will close. The line 70 is connected to a port 86 and the valve 72 includes a spool 90 having a land 92 provided with metering slots 94. A spring 96 biases the spool 90 to the right, that is, towards an open position. A feedback passage 98 opens on a side of the spool 90 to the left of the land 92 and to the right-hand end of the spool. Thus, pressure within the port 86 will be applied to the right-hand end of the spool 90 to counterbalance the opening force supplied thereto by the spring 96.

In operation, as flow from the line 74 to the line 70 through the metering slots 94 increases, such flow being resisted by the metering slots 44 in the main control valve 20, a higher pressure will be generated in the port 86 which will be fed back to the right-hand end of the spool 90 to tend to close the valve to thereby further restrict flow. As a consequence, overruning of the load, for example, in a negative load situation, cannot occur.

As alluded to previously, it is desirable to match the flow from the pump to the cylinder 10 against the flow from the cylinder 10 to the reservoir. For this purpose, a modulating valve, generally designated 100, is interposed between the pump 58 and the control valve 20. The modulating valve 100 includes a spool 102 including a land 104 provided with metering slots 106. On one side of the land 104 is a port 108 which is connected to the inlet port 22 of the main control valve. On the opposite side of the land 104 is a port 110 which receives the discharge of the pump 58. The spool 102 is biased towards an open position by a spring 112 acting against the left-hand end of the spool 102 while the right-hand end of the spool 102 is provided with a pressure responsive surface 114 which may receive a fluid signal tending to close the valve.

The signal applied to the surface 114 is received on a line 116 which is connected to the output of a low pressure resolver 118. The resolver 118 has a first input received on a line 120 connected to the port 82 of the valve 72. A second input is received on a line 122 similarly connected to the valve 78, that is, in constant fluid communication with the line 80 and, thus, the rod end port of the cylinder 10.

The resolver 118 includes an internal, shiftable dumbbell-shaped element 124 and is conventional in configuration. It will be appreciated that when a higher pressure exists in the line 120 than in the line 122, the element 124 will shift to the position illustrated in the FIGURE with the result that a fluid flow path is established from the line 122 to the line 116. Thus, the lowest pressure of the two at the ports of the motor 10 is provided to the valve 100. Conversely, when the pressure in the line 122 is higher than in the line 120, the element 124 will shift to the left from the position shown, thereby connecting the line 120 to the line 116, again providing the lowest pressure signal.

In the case of a so-called "negative load situation", that is, when fluid is being exhausted from the head end of the cylinder 10, system operation insofar as the valves 20 and 72 is concerned, will occur as previously. This will be true even though the load may tend to overrun due to the throttling action on the exhaust fluid provided by the valve 72.

At the same time, however, since the spool 34 will be shifted somewhat to the right to cause lowering of the load, fluid communication will be established in the valve 20 from the inlet 22 to the annulus 30 to supply fluid to the rod end of the cylinder 10. This fluid will be at a positive pressure dependent upon the force applied to the left-hand end of the spool 102 of the valve 100.

For example, initially, no pressure will be applied to the surface 114 of the spool 102. Pump pressure will be applied to the rod end of the cylinder. As load pressure begins to build up in the line 74 due to the resistance caused by the metering of slots 44 and 94 in the exhaust path, pump pressure will appear in the line 122. Due to the presence of the load, the pressure in the line 120 will be higher so that the resolver 118 will assume the condition illustrated with the result that the pressure at the rod end of the cylinder 10 will cause the valve 102 to shift to the left to meter flow from the pump 58 to the main control valve 20. As a consequence, through balancing action of the spring 112 and the pressure applied to the surface 114, a constant positive pressure will be maintained on the rod end of the cylinder 10 to prevent cavitation. Typically, the pressure will be on the order of 50 psi, but the value may vary dependent upon system requirements.

At the same time, output pressure of the pump 58 will not be increased as resistance to fluid flow to the rod end port increases due to metering action of the slots 44 and 94. Specifically, as the spool 102 shifts to the left in response to the application of pressure via the line 116, the pressure in the outlet port 108, and thus in the inlet port 22 of the main control valve 20, will be decreased. This decrease in pressure will be sensed by the uncovered load sensing port 50 and returned via line 54 to the pressure compensating mechanism 56 of the pump 58. As a result, the pump 58 will be altered to lower its output pressure in response to the apparently lower load pressure.

Should the pressure to the line 80 fall off below the desired value as a result of such action, pressure applied to the surface 114 will be commensurately decreased with the result that the valve 100 will open slightly. Equilibrium will shortly be obtained thus providing for a constant, relatively low pressure in the line 80.

For positive load conditions, flow matching is similarly obtained, as will be apparent to those skilled in the art.

From the foregoing, it will be appreciated that a hydraulic system made according to the invention provides for automatic matching of pump to cylinder flows with cylinder to reservoir flow for all load conditions. The same avoids any need for uneconomical controlled size orifices or matched springs as well as provides a compact valve arrangement which is uncomplicated and inexpensive to manufacture.

The embodiments of the invention in which an exclusive property or privilege is claimed are defined as follows:

1. A hydraulic system comprising:
a bidirectional hydraulic motor having first and second fluid ports;
a pump;
a control valve for selectively connecting said pump to (a) said first port and venting said second port and (b) said second port and venting said first port;
a modulating valve interposed between said pump and said control valve for varying flow from said pump to said control valve;
a pilot for said modulating valve; and
pressure responsive means for selecting the lowest pressure at said ports and for directing a low pressure signal to said pilot.

2. A hydraulic system comprising:
a bidirectional hydraulic motor having first and second fluid ports;
a pump;

a control valve for selectively connecting said pump to (a) said first port and venting said second port and (b) said second port and venting said first port;

a modulating valve interposed between said pump and said control valve for varying flow from said pump to said control valve, said modulating valve being a normally open valve, spring biased to an open position;

an actuator for said modulating valve, said actuator being a pilot which, when pressurized, will tend to close said modulating valve;

pressure responsive means for determining the relative pressure at said ports and for providing a control signal representative of the pressure having a preselected relation with respect to the other to said actuator, said determining means providing a low pressure fluid signal to said pilot representative of the lesser pressure at said ports.

3. The hydraulic system of claim 2 wherein said determining means comprises a low pressure resolver having its output connected to said pilot and inputs connected to respective ones of said ports.

* * * * *